US008863983B2

(12) United States Patent
Meers et al.

(10) Patent No.: US 8,863,983 B2
(45) Date of Patent: Oct. 21, 2014

(54) GASKETLESS PAIL LID

(71) Applicant: Rehrig Pacific Company, Los Angeles, CA (US)

(72) Inventors: Ryan Meers, West Chester, PA (US); Kyle L. Baltz, Rossmoor, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 78 days.

(21) Appl. No.: 13/621,410

(22) Filed: Sep. 17, 2012

(65) Prior Publication Data

US 2013/0068780 A1 Mar. 21, 2013

Related U.S. Application Data

(60) Provisional application No. 61/535,776, filed on Sep. 16, 2011.

(51) Int. Cl.

| | |
|---|---|
| ***B65D 39/00*** | (2006.01) |
| ***B65D 41/16*** | (2006.01) |
| ***B65D 41/18*** | (2006.01) |
| ***B65D 43/02*** | (2006.01) |

(52) U.S. Cl.

CPC .. *B65D 43/0256* (2013.01); *B65D 2543/00296* (2013.01); *B65D 2543/00092* (2013.01); *B65D 43/0212* (2013.01); *B65D 2543/00648* (2013.01); *B65D 2543/0099* (2013.01); *B65D 2543/00537* (2013.01); *B65D 2543/00509* (2013.01); *B65D 2543/00805* (2013.01); *B65D 2543/00555* (2013.01); *B65D 2543/0074* (2013.01); *B65D 2543/00685* (2013.01)

USPC ..... 220/792; 215/344; 220/780

(58) Field of Classification Search

USPC ..... 220/790, 200, 378, 780, 792, 784, 789, 220/794, 795, 276; 215/344, 256

See application file for complete search history.

(56) References Cited

U.S. PATENT DOCUMENTS

| | | | | |
|---|---|---|---|---|
| 3,817,420 | A * | 6/1974 | Heisler | 220/790 |
| 5,292,024 | A * | 3/1994 | Koefelda et al. | 220/608 |
| 7,090,088 | B2 * | 8/2006 | von Holdt, Jr. | 220/276 |
| 7,963,419 | B2 * | 6/2011 | Burney et al. | 220/780 |
| 8,181,819 | B2 | 5/2012 | Burney et al. | |
| 8,210,391 | B2 * | 7/2012 | Luburic | 220/635 |
| 8,459,486 | B2 * | 6/2013 | Luburic et al. | 220/276 |

* cited by examiner

*Primary Examiner* — Andrew Perreault

(74) *Attorney, Agent, or Firm* — Carlson, Gaskey & Olds

(57) ABSTRACT

A lid for a pail includes a panel portion and a wall portion extending about the periphery of the panel portion. The wall portion partially defines a pail wall receiving recess. A shoulder protrudes into the pail wall receiving recess. The shoulder prevents damage to a seal in the lid.

19 Claims, 5 Drawing Sheets

GASKETLESS PAIL LID

BACKGROUND

Pails (round or square) are often enclosed by a removable and reclosable lid. The lid may include a panel portion and a plurality of wall portions about the periphery of the panel portion. A pail wall receiving recess is defined between the wall portions.

A flexible seal may extend downward between the wall portions into the pail wall receiving recess to form a seal against an upper end of the pail inserted into the pail wall receiving recess. The flexible seal seals the lid and the pail, but if the lid is pressed or pounded onto the pail with excessive force, the upper end of the wall of the pail can damage the flexible seal.

SUMMARY

A lid for a pail includes a panel portion and a wall portion extending about the periphery of the panel portion. The wall portion partially defines a pail wall receiving recess. A shoulder protrudes into the pail wall receiving recess. The shoulder prevents damage to a seal in the lid.

DESCRIPTION OF A PREFERRED EMBODIMENT

A gasketless pail lid 10 according to one embodiment of the present invention is shown in FIGS. 1-5.

Figure 1:
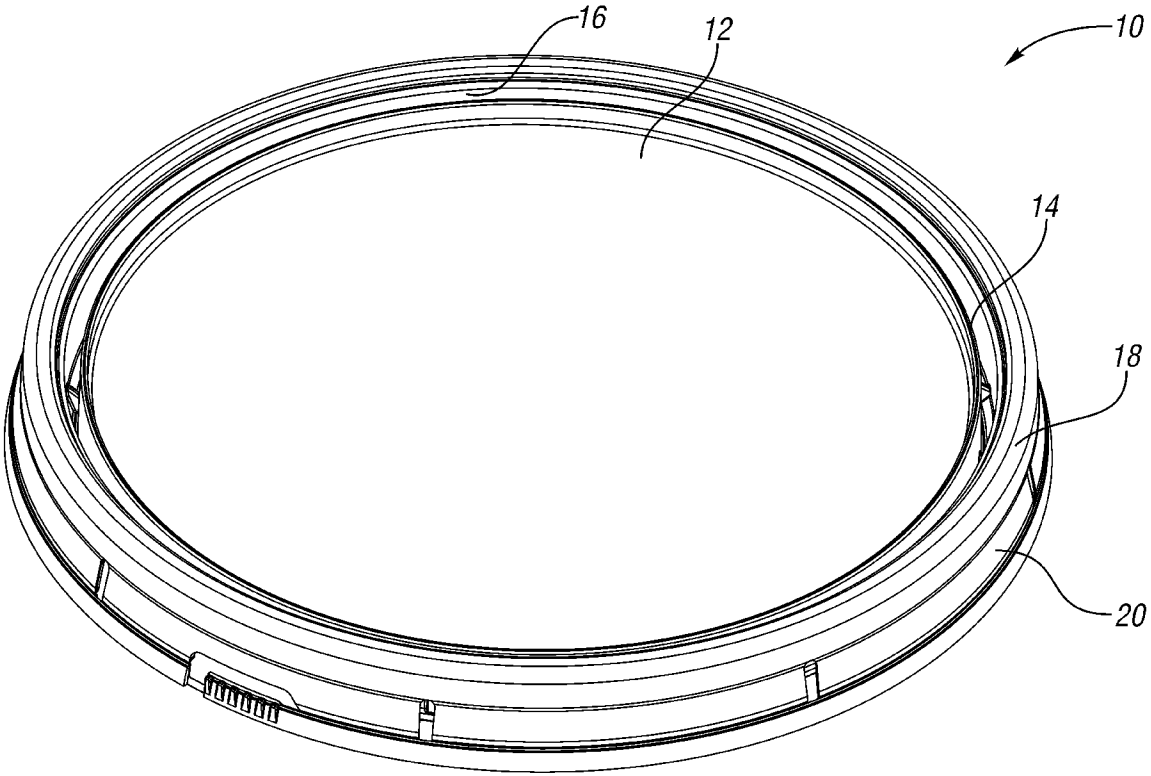
FIG. 1 is a perspective view of a pail lid according to one embodiment of the present invention.

Referring to FIG. 1, the lid 10 includes a generally circular panel portion 12 circumscribed by a generally vertical, annular, inner wall portion 14. The inner wall portion 14 is spaced inward from and circumscribed by a generally vertical, annular, mid-wall portion 16, which in turn is spaced inward from and circumscribed by a generally vertical, annular outer wall portion 18. The lid 10 may optionally include one or more tear strips 20 at a lower end of the outer wall portion 18.

Figure 2:
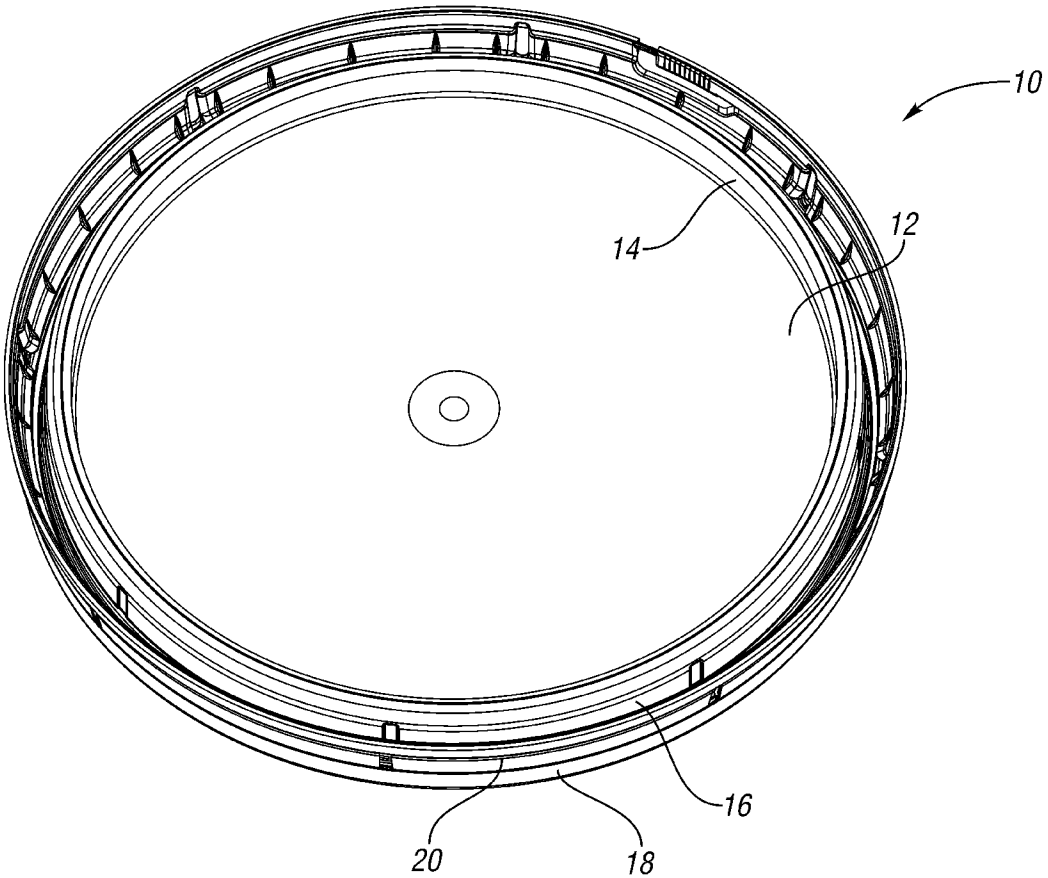
FIG. 2 is a bottom perspective view of the pail lid of FIG. 1.
Figure 3:
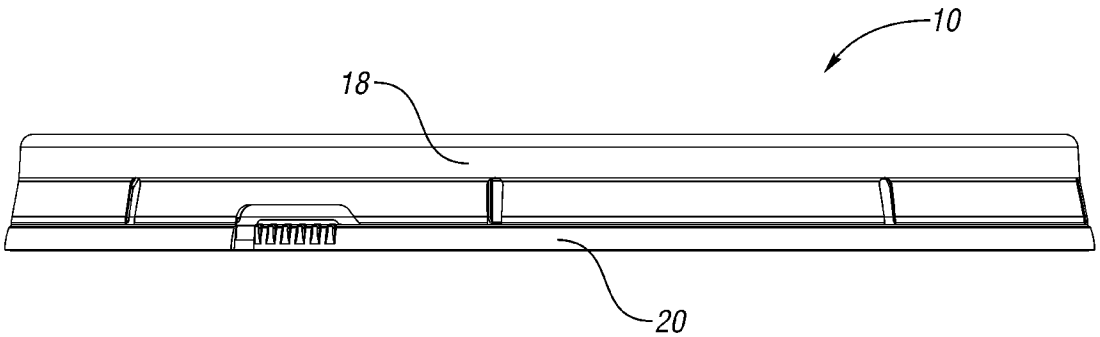
FIG. 3 is a side view of the pail lid of FIG. 1.

FIG. 2 is a bottom perspective view of the lid 10. As shown, the inner wall portion 14, the mid-wall portion 16 and the outer wall portion 18 protrude downward of the circular panel portion 12. FIG. 3 is a side view of the lid 10.

Figure 4:
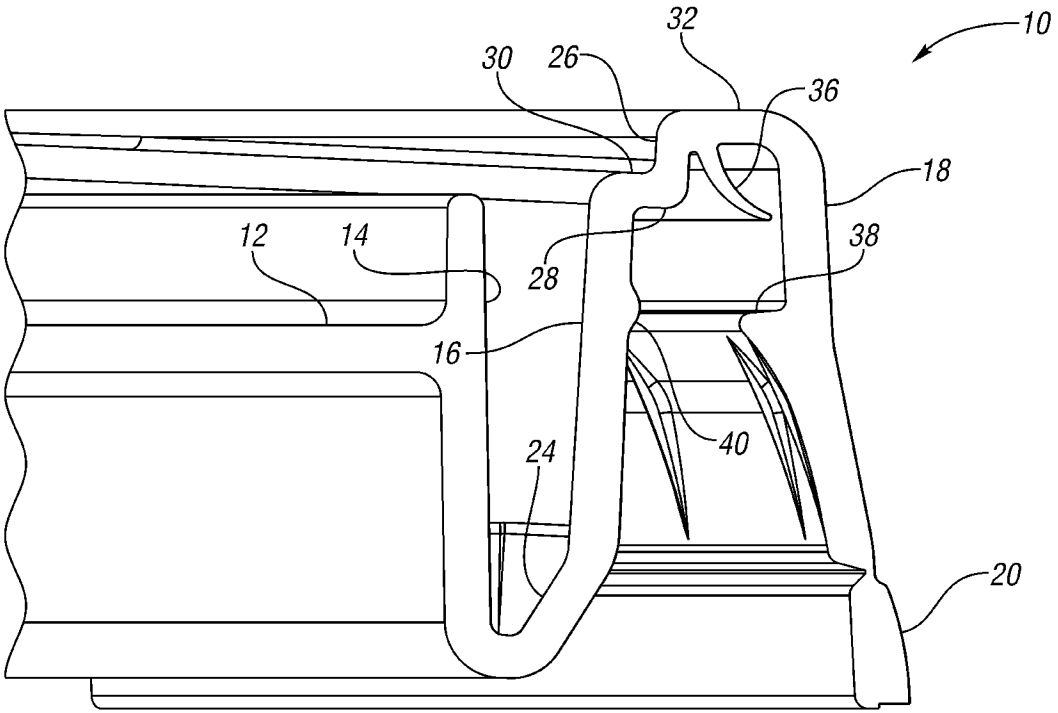
FIG. 4 is a section view through the outer ring portion of the pail lid of FIG. 1.

FIG. 4 is a section view through an outer portion of the lid 10. As shown, the inner wall portion 14 may, but need not, protrude upward higher than the panel portion 12. A lower end of the inner wall portion 14 is connect to a lower end of the mid-wall portion 16 by an angled wall portion 24 that angles upward from the lower end of the inner wall portion 14 to the lower end of the mid-wall portion 16. An annular pail wall receiving recess is defined between the inner wall portion 14 and the outer wall portion 18.

An offset portion 26 extends upward from an upper end of the mid-wall portion 16 and is offset outwardly relative to the mid-wall portion 16, thereby defining a shoulder 28 having a downward-facing contact surface and an upper recess 30. The offset portion 26 is offset radially outward to define the shoulder 28. The shoulder 28 protrudes into the pail wall receiving recess. An annular upper wall portion 32 connects an upper end of the offset portion 26 to an upper end of the outer wall portion 18. A flexible seal 36 molded integrally with the lid 10 extends downward and outward from the upper wall portion 32 toward the outer wall portion 18. The seal 36 extends downward below the shoulder 28.

An interior surface of the outer wall portion 18 includes an upper ledge 38 spaced below the seal 36. An integral bead or cork seal 40 is formed on an exterior surface of the mid-wall portion 16 roughly opposite the upper ledge 38. As is shown in FIG. 5, and as is well-known, the tear strip 20 is removable secured to a lower end of the outer wall 18.

Figure 5:
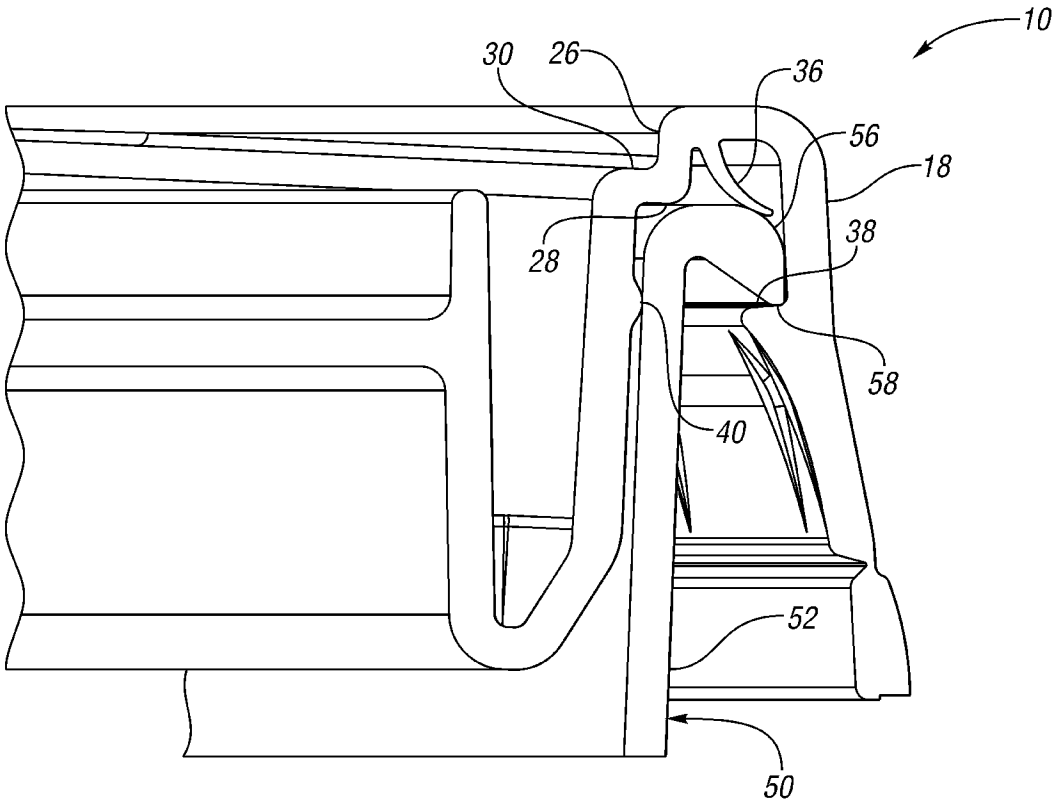
FIG. 5 shows the pail lid of FIG. 4 secured to a pail.

FIG. 5 shows a section of the lid 10 secured to an upper end of a pail 50. The pail 50 includes a pail wall 52 having an outwardly protruding lip 58. When the lid 10 is snapped onto the pail 50, the lip 58 of the pail 50 snaps past the ledge 38 on the outer wall portion 18. The cork seal 40 contacts the pail wall 52. The lip 58 (and/or the upper end of the pail wall 52) contacts the seal 36 and deflects the seal 36, forming a seal between the lid 10 and the pail 50. To prevent damage to the seal 36, such as by over-deflection when the lid 10 is snapped onto the pail 50 with excessive force, the lip 58 and/or upper end of the pail wall 52 will contact the shoulder 28 on the lid 10, preventing the lip 58 from deflecting the seal 36 upward further than the shoulder 28. The shoulder 28 acts as a stop limiting insertion of the lip 58 and upper end of the pail wall 52.

The lid 10 and pail 50 are each integrally molded as a single piece of suitable plastic, such as HDPE, polypropylene, etc.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, although the lid is shown as circular for use on a cylindrical pail, the invention could also be used with a rectangular lid for a rectangular pail.

What is claimed is:

1. A lid for a pail comprising:

a panel portion;

a mid-wall portion and an outer wall portion extending about the periphery of the panel portion, the mid-wall portion, the outer wall portion and an upper wall portion defining a pail wall receiving recess;

a shoulder protruding into the pail wall receiving recess; and a seal extending downward and outward from the upper wall portion toward the outer wall portion, the seal integrally molded with the upper wall portion, wherein the seal extends downward below the shoulder in an undeflected state, wherein an interior surface of the outer wall portion includes an upper ledge spaced below the seal.

2. The lid of claim 1 wherein the shoulder is defined by an offset portion of the mid-wall portion.

3. The lid of claim 2 wherein the offset portion is formed at an upper end of the mid-wall portion.

4. The lid of claim 3 wherein the mid-wall portion is spaced outward from an inner wall portion.

5. The lid of claim 4 wherein the mid-wall portion is generally perpendicular to the panel portion.

6. The lid of claim 5 wherein the inner wall portion extends downward from the periphery of the panel portion and the mid-wall portion extends upward from a lower end of the inner wall portion.

7. The lid of claim 6 wherein the shoulder protrudes outward from the mid-wall portion.

8. The lid of claim 7 wherein the outer wall portion is spaced outward from the mid-wall portion, the pail wall receiving recess defined between the mid-wall portion and the outer wall portion.

9. The lid of claim 8 wherein the upper wall portion extends between an upper edge of the mid-wall portion and an upper edge of the outer wall portion.

10. The lid of claim 1 wherein an interior surface of the outer wall portion includes an upper ledge spaced below the seal.

11. The lid of claim 3 wherein the wall portion is a mid-wall portion, the mid-wall portion spaced outward from an inner wall portion, the mid-wall portion is generally perpendicular to the panel portion, the inner wall portion extending downward from the periphery of the panel portion and the mid-wall portion extends upward from a lower end of the inner wall portion, further including an outer wall portion spaced outward from the mid-wall portion, the pail wall receiving recess defined between the mid-wall portion and the outer wall portion.

12. The lid of claim 11 further including an upper wall portion extending between an upper edge of the mid-wall portion and an upper edge of the outer wall portion.

13. The lid of claim 1 wherein the wall portion is annular.

14. The lid of claim 1 in combination with a pail having a pail wall, wherein the lid is secured to an upper edge of the pail wall, with the upper edge of the pail wall received in the wall receiving recess.

15. The lid and pail of claim 14 wherein the upper edge of the pail wall includes an outwardly protruding lip snap-fit past the ledge and deflecting the seal.

16. The lid and pail of claim 15 wherein the upper edge of the pail wall is spaced downward from the shoulder.

17. The lid and pail of claim 16 wherein the upper edge of the pail wall is capable of contacting the shoulder upon sufficient downward force on the lid deflecting the seal.

18. A lid for a pail comprising:

a panel portion;

an inner wall portion extending downward from a periphery of the panel portion;

a mid-wall portion extending upward from the inner wall portion;

an outer wall portion spaced outward from the mid-wall portion, a pail wall receiving recess defined between the mid-wall portion and the outer wall portion;

a stop protruding into the pail wall receiving recess limiting insertion of a pail wall;

a flexible seal extending downward into the pail wall receiving recess downward past the stop, the seal integrally molded with the lid; and wherein the stop protrudes into the pail wall receiving recess from the mid-wall portion.

19. A lid and a pail in combination comprising:

the lid including a panel portion, an outer wall portion extending about the periphery of the panel portion, the outer wall portion partially defining a pail wall receiving recess, a shoulder protruding into the pail wall receiving recess, wherein an interior surface of the outer wall portion includes an upper ledge below the shoulder, and a flexible seal extending downward adjacent the shoulder; and the pail having a pail wall, the upper edge of the pail wall including an outwardly protruding lip snap-fit past the ledge and deflecting the seal;

wherein the lid is secured to an upper edge of the pail, with the upper edge of the pail wall is received in the wall receiving recess and the seal contacted by and deflected by the upper edge of the pail wall, and further including a gap between the upper edge of the pail wall and the shoulder; wherein the shoulder is defined by an offset portion at an upper end of a mid-wall portion; further including an upper wall portion extending between an upper edge of the mid-wall portion and an upper edge of the outer wall portion; and wherein the seal extends downward and outward from the upper wall portion toward the outer wall portion, wherein the seal extends downward below the shoulder.

* * * * *